US010301734B2

(12) United States Patent
Hayashi

(10) Patent No.: US 10,301,734 B2
(45) Date of Patent: May 28, 2019

(54) NON-CYANIDE BASED AU—SN ALLOY PLATING SOLUTION

(71) Applicant: Katsunori Hayashi, Tokyo (JP)

(72) Inventor: Katsunori Hayashi, Tokyo (JP)

(73) Assignee: Electroplating Engineers of Japan Limited, Tokyo (JP)

( * ) Notice: Subject to any disclaimer, the term of this patent is extended or adjusted under 35 U.S.C. 154(b) by 141 days.

(21) Appl. No.: 15/472,620

(22) Filed: Mar. 29, 2017

(65) Prior Publication Data

US 2017/0292200 A1 Oct. 12, 2017

(30) Foreign Application Priority Data

Apr. 12, 2016 (JP) ..... P2016-079382

(51) Int. Cl.

| | |
|---|---|
| ***C23C 18/40*** | (2006.01) |
| ***C25D 3/60*** | (2006.01) |
| ***C25D 3/62*** | (2006.01) |
| ***C22C 5/02*** | (2006.01) |
| ***C25D 7/12*** | (2006.01) |

(52) U.S. Cl.
CPC ..... *C25D 3/62* (2013.01); *C22C 5/02* (2013.01); *C25D 7/12* (2013.01)

(58) Field of Classification Search
CPC ..... C23C 18/42; C25D 3/60; C25D 3/62
USPC ..... 106/1.26; 205/247, 248, 253
See application file for complete search history.

(56) References Cited

U.S. PATENT DOCUMENTS

2005/0252783 A1* 11/2005 Hradil ..... C25D 3/62
205/247

FOREIGN PATENT DOCUMENTS

| | | | | |
|---|---|---|---|---|
| JP | 53-110929 A | | 9/1978 | |
| JP | H04268089 A | | 9/1992 | |
| JP | H0853790 A | | 2/1996 | |
| JP | 2003171789 A | * | 6/2003 | ..... C25D 3/62 |
| JP | 2003221694 A | | 8/2003 | |

* cited by examiner

*Primary Examiner* — Edna Wong
(74) *Attorney, Agent, or Firm* — Roberts & Roberts, LLP

(57) ABSTRACT

The present invention provides a non-cyanide based Au—Sn alloy plating solution capable of performing a Au—Sn alloy plating treatment by a plating solution composition that is neutral and does not contain cyanide. In the present invention, a non-cyanide soluble gold salt, a Sn compound composed of tetravalent Sn, and a thiocarboxylic acid-based compound are contained. The non-cyanide based Au—Sn alloy plating solution of the present invention can further contain sugar alcohols, and, in addition, can further contain a dithioalkyl compound.

12 Claims, 1 Drawing Sheet

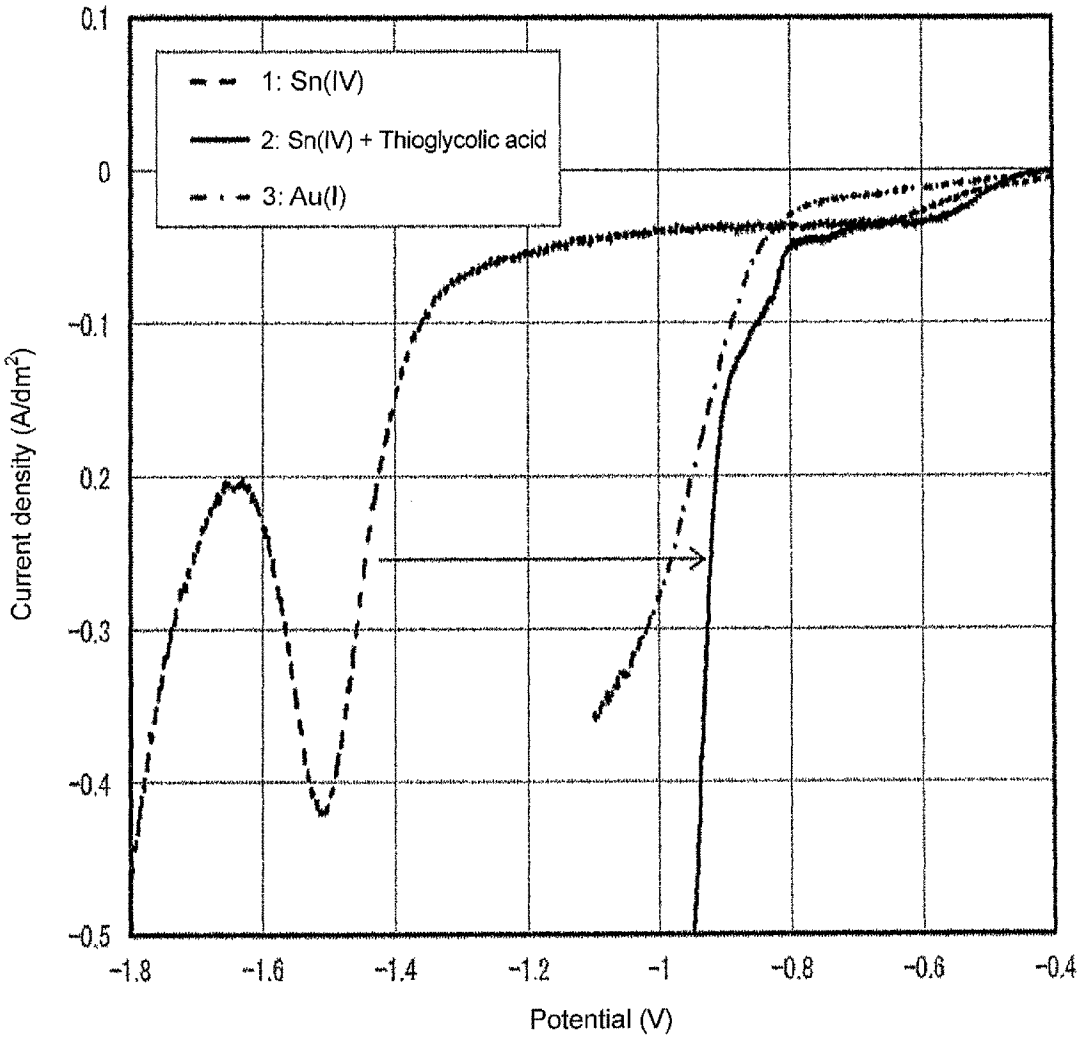
1: Sn(IV)
2: Sn(IV) + Thioglycolic acid
3: Au(I)
0.1
0
-0.1
0.2
-0.3
-0.4
-0.5
Current density (A/dm²)
-1.8
-1.6
-1.4
-1.2
-1
-0.8
-0.6
-0.4
Potential (V)

NON-CYANIDE BASED AU—SN ALLOY PLATING SOLUTION

BACKGROUND OF THE INVENTION

1. Field of the Invention

The present invention relates to a non-cyanide based Au—Sn alloy plating solution, in particular, to a non-cyanide based Au—Sn alloy plating solution using a tetravalent Sn compound.

2. Description of Related Art

Au—Sn alloys exert high connection reliability, and are used for forming a junction part of an electronic component or the like. Further, as a method for forming a junction part with the Au—Sn alloy, there is known a method of using a Au—Sn alloy plating solution (for example, see PTLs 1 to 4).

As conventional Au—Sn alloy plating solutions, there are known cyanide-based Au—Sn alloy plating solutions containing cyan. With regard to the cyanide-based Au—Sn alloy plating solutions, there are indicated an environmental problem caused by toxicity of cyan and such a problem of liquid stability that an insoluble compound is formed by generation of tetravalent Sn due to oxidation of a divalent Sn compound and deposition is generated.

About the Au—Sn alloy plating solution, when it is tried to produce a non-cyanide based Au—Sn alloy plating solution, a non-cyanide Au compound has low stability as compared with a cyan-containing Au compound, and, therefore, such a problem may occur that Au is deposited by a disproportionation reaction as shown by (1).

$$2Au(I)+Sn(II)\rightarrow 2Au\downarrow+Sn(IV) \quad (1)$$

Further, even when it is tried to use tetravalent Sn in order to avoid problems of liquid stability such as generation of deposition caused by the disproportionation reaction or oxidation of a Sn compound, the difference in precipitation potentials between Au(I) and Sn(IV) is very large, and, therefore, it is difficult to obtain good liquid stability and a constant eutectoid of Au—Sn.

Accordingly, although a source of Au is not specified in PTLs 1, 3 and 4, as practical examples, only an example using gold potassium cyanide is described, and, if the gold potassium cyanide in the example is substituted, for example, by a gold sulfite salt or the like, a stable liquid as a plating solution is not formed, and the present state is that a non-cyanide based Au—Sn plating solution practicable in industrial applications is not obtained.

CITATION LIST

Patent Literature

PTL 1: Japanese Patent Laid-Open Publication No. 53-110929

PTL 2: Japanese Patent Laid-Open Publication No. 04-268089

PTL 3: Japanese Patent Laid-Open Publication No. 08-53790

PTL 4: Japanese Patent Laid-Open Publication No. 2003-221694

SUMMARY OF THE INVENTION

Technical Problem

The present invention has been achieved with such circumstances as the context, and provides a non-cyanide based Au—Sn alloy plating solution capable of performing a Au—Sn alloy plating treatment by a plating solution composition that is neutral and does not contain cyanide.

Solution to Problem

The present inventor conceived of a Au—Sn alloy plating solution according to the present invention, as the result of hard studies of conventional Sn compounds composed of tetravalent Sn.

The non-cyanide based Au—Sn alloy plating solution according to the present invention is characterized to contain a non-cyanide soluble gold salt, a Sn compound composed of tetravalent Sn, and a thiocarboxylic acid-based compound.

Examples of Sn compounds composed of tetravalent Sn (hereinafter, occasionally described simply as Sn) in the present invention include potassium stannate (IV), sodium stannate (IV), tin (IV) halide, tin (IV) oxide, tin (IV) acetate, tin (IV) sulfate, or the like. As particularly preferable compounds, potassium stannate (IV) and sodium stannate (IV) are mentioned.

Further, a thiocarboxylic acid-based compound in the present invention is used as a complexing agent that stabilizes tetravalent Sn, and as a precipitation accelerating agent that changes a precipitation potential of tetravalent Sn to allow precipitation of an alloy with Au. Examples of the thiocarboxylic acid-based compounds include thiomonocarboxylic acid such as thioglycolic acid, cysteine, mercaptobenzoic acid and mercaptopropionic acid, and salts thereof, and thiodicarboxylic acid such as thiomalic acid and dimercaptosuccinic acid, and salts thereof. As particularly preferable compounds, thioglycolic acid and cysteine being thiomonocarboxylic acid are mentioned.

Furthermore, examples of non-cyanide soluble gold salts in the present invention include gold sulfite salts, gold thiosulfate salts, chloroauric acid salts, and gold hydroxide salts. As a particularly preferable salt, gold sodium sulfite is mentioned.

The non-cyanide based Au—Sn alloy plating solution according to the present invention has a little influence on environment because of having neutral region pH and not containing cyan, can remove an instability factor of the liquid due to oxidation of the Sn compound by using tetravalent Sn, and is suitable for a plating treatment of a semiconductor wafer or the like.

The non-cyanide based Au—Sn alloy plating solution according to the present invention preferably further includes sugar alcohols. The sugar alcohols function as a secondary complexing agent for Sn, exert an effect of enhancing stability of Sn in a neutral region and, in addition, have moderate complexing power and do not inhibit precipitation of Sn. Examples of sugar alcohols include D(−)-sorbitol, D(−)-mannitol, and xylitol. Particularly preferable are D(−)-sorbitol and xylitol.

The non-cyanide based Au—Sn alloy plating solution according to the present invention preferably further includes a dithioalkyl compound (R—S—S—R'). The dithioalkyl compound functions as a secondary complexing agent of a soluble gold salt, and exerts an effect of enhancing the stability as the non-cyanide based Au—Sn alloy plating solution. Examples of dithioalkyl compounds include 3,3'-dithiobis(1-propanesulfonic acid) and salts thereof, 2,2'-dithiobis(ethanesulfonic acid) and salts thereof, and dithiodiglycollic acid and salts thereof. Particularly preferable is 3,3'-dithiobis(1-propanesulfonic acid)sodium.

In the present invention, concentrations of a soluble gold salt and a Sn compound composed of tetravalent Sn are set according to the ratio in a targeted Au—Sn alloy, or the like, and are, preferably, 1 to 10 g/L as Au metal, and 1 to 20 g/L as Sn metal. When the concentration of the metal is too low, a problem that sufficient precipitation efficiency cannot be obtained, for example, occurs easily, and, when the concentration is too high, a problem that the solution stability deteriorates, for example, occurs easily.

In the present invention, the thiocarboxylic acid-based compound desirably has a concentration ratio of thiocarboxylic acid-based compound/Sn=0.5 to 4 in molar ratio relative to Sn metal, and more preferably a concentration ratio of 1 to 3. When the molar ratio is less than 0.5, a eutectoid of Sn is difficult to be obtained and the liquid becomes unstable easily as a plating solution. When the molar ratio exceeds 4, there is such a risk that liquid stability or precipitation characteristics are affected.

In the present invention, when sugar alcohols are further contained, the sugar alcohols desirably have a concentration ratio of sugar alcohols/Sn=0.5 to 3 in molar ratio relative to Sn metal, and more preferably a concentration ratio of 0.5 to 2. When the molar ratio is less than 0.5, the liquid becomes unstable easily as a plating solution, and, when the molar ratio exceeds 3, there is such a risk that liquid stability or precipitation characteristics are affected.

In the present invention, when a dithioalkyl compound is further contained, the dithioalkyl compound desirably has a concentration ratio of dithioalkyl compound/Au=0.5 to 3 in molar ratio relative to Au metal, and more preferably a concentration ratio of 1 to 2. When the molar ratio is less than 0.5, the liquid becomes unstable easily as a plating solution, and, when the molar ratio exceeds 3, there is such a risk that liquid stability or precipitation characteristics are affected.

The non-cyanide based Au—Sn alloy plating solution according to the present invention is preferably used for a plating treatment under conditions of 6 to 9 in pH, 0.1 to 1 A/dm$^2$ in current density, and 25 to 70° C. in liquid temperature. When the pH is low, a Sn-rich state appears and the liquid stability tends to lower, and when the pH is high, a Au-rich state tends to appear. Further, when the current density is low, a Au-rich state tends to appear, and, when the current density is high, a Sn-rich state and deteriorated appearance of a precipitation tend to appear. Moreover, when the liquid temperature is low, a Sn-rich state tends to appear, and, when the liquid temperature is high, a Au-rich state tends to appear and, when the temperature exceeds 70° C., liquid stability tends to lower. Practically, it is desirable that pH is set to 6.5 to 8, the current density is set to 0.2 to 0.6 A/dm$^2$, and the liquid temperature is set to 30 to 60° C.

The non-cyanide based Au—Sn alloy plating solution according to the present invention can contain, as a conducting salt, various inorganic and organic salts that do not inhibit the precipitation of Au and Sn. For example, a sulfate, a hydrochloride, a nitrate, a phosphate, dihydroxyethylglycine or the like may suitably be added. However, a citrate, a gluconate, a tartrate or the like known as a complexing agent of Sn, such as those used in PTLs 1, 3 and 4, work as a factor that hinders the precipitation of Sn, and, therefore, they are not desirable for the non-cyanide based Au—Sn alloy plating solution according to the present invention.

In addition, the non-cyanide based Au—Sn alloy plating solution according to the present invention can contain a known additive unless it hinders the precipitation of Au and Sn. For example, it is also possible to add suitably an oxidation inhibitor for enhancing the stability of the liquid, a flattening agent for enhancing the flatness of a precipitate, or a surfactant for lowering the surface tension of the plating solution.

Advantageous Effects of Invention

According to the non-cyanide based Au—Sn alloy plating solution of the present invention, the influence on environment can be reduced and the lowering of liquid stability such as generation of deposition due to oxidation of a Sn compound does not occur, and, therefore, it is possible to effectively apply Au—Sn alloy plating to an object to be plated such as a semiconductor wafer.

BRIEF DESCRIPTION OF THE DRAWINGS

FIG. 1 shows a graph of measurement of current-potential.

DETAILED DESCRIPTION OF THE PREFERRED EMBODIMENTS

Hereinafter, an embodiment of the non-cyanide based Au—Sn alloy plating solution according to the present invention will be described based on Examples.

In the present embodiment, Au—Sn alloy plating solutions of following compositions were examined.

TABLE 1

| | Au g/L | Sn g/L | (A) g/L | (B) g/L | (C) g/L | (D) g/L | (E) g/L | (F) g/L | (G) g/L | (H) g/L |
|---|---|---|---|---|---|---|---|---|---|---|
| Example 1 | 1 | 2 | 4.7 | 0 | 0 | 0 | 0 | 0 | 0 | 0 |
| Example 2 | 1 | 2 | 0 | 6.1 | 0 | 0 | 0 | 0 | 0 | 0 |
| Example 3 | 2 | 2 | 3.1 | 0 | 6.2 | 0 | 0 | 0 | 0 | 0 |
| Example 4 | 1 | 2 | 3.1 | 0 | 6.2 | 0 | 0 | 0 | 100 | 0 |
| Example 5 | 5 | 20 | 31 | 0 | 62 | 9 | 0 | 20 | 0 | 0 |
| Example 6 | 3 | 4 | 6.2 | 0 | 12.3 | 10.8 | 20 | 0 | 15 | 5 |
| Comparative example 1 | 1 | 2 | 0 | 0 | 0 | 0 | 0 | 0 | 0 | 0 |
| Comparative example 2 | 3 | 4 | 0 | 0 | 0 | 0 | 0 | 0 | 0 | 0 |

Au: Gold sodium sulfite
Sn: Potassium stannate (IV) trihydrate
(A): Thioglycolic acid
(B): Cysteine
(C): D(−)-sorbitol
(D): 3,3'-dithiobis(1-propanesulfonic acid) sodium
(E): N,N-di(2-hydroxyethyl)glycine
(F): Sodium sulfate
(G): Potassium nitrate
(H): Sodium dihydrogen phosphate For each plating solution shown in Table 1, a plating treatment was performed, with a test piece made of Cu (2 cm×2 cm) as an object to be plated, and by use of a mesh anode made of Pt/Ti as an anode.

As evaluation items of each plating solution, stability of the liquid, a Au—Sn precipitation ratio of the plated film and a precipitation efficiency were investigated. The stability of the liquid was evaluated by visual observation of the state of liquid after preparation of each plating solution. A Au—Sn precipitation ratio of the plated film was measured with an X-ray fluorescence thickness meter (SFT-9550), and the precipitation efficiency was calculated from weight difference between test pieces before and after the plating. Evaluation results of each plating solution are shown in Table 2.

TABLE 2

| | pH | Liquid temperature ° C. | Current density A/dm$^2$ | Precipitation ratio Au:Sn (%) | Precipitation efficiency mg/A · min | Liquid stability |
|---|---|---|---|---|---|---|
| Example 1 | 8.0 | 40 | 0.4 | 80:20 | 49.0 | Δ |
| Example 2 | 8.0 | 40 | 0.4 | 79:21 | 48.5 | Δ |
| Example 3 | 7.0 | 40 | 0.5 | 80:20 | 48.8 | Δ |
| Example 4 | 7.0 | 40 | 0.5 | 71:29 | 36.5 | Δ |
| Example 5 | 7.0 | 40 | 0.5 | 75:25 | 44.0 | ○ |
| Example 6 | 7.2 | 50 | 0.4 | 79:21 | 49.0 | ◎ |
| Comparative example 1 | 8.0 | 40 | 0.4 | 90:10 | 22.5 | X |
| Comparative example 2 | 8.0 | — | — | — | — | XX |

Liquid stability:
◎: no trouble was generated by 6-month neglect after the plating test
○: slight turbidity was generated by 1-week neglect after the plating test
Δ: turbidity was generated by neglect for a while after the plating test
X: slight turbidity existed when the plating solution was prepared, and turbidity was generated after the plating test
XX: turbidity was generated when the plating solution was prepared Further, in Example 6, there was performed a test of precipitating Au by plating in the same amount as the amount of Au contained in the plating solution and replenishing reduced components, as a running treatment of 1 MTO. The results are shown in Table 3.

TABLE 3

| MTO | Precipitation ratio Au:Sn (%) | Precipitation efficiency mg/A · min | Liquid stability |
|---|---|---|---|
| 0 | 79:21 | 49.0 | ◎ |
| 0.25 | 79.5:20.5 | 49.0 | |
| 0.5 | 80.5:19.5 | 48.5 | |
| 0.75 | 80.3:19.7 | 48.0 | |
| 1.0 | 79.8:20.5 | 49.0 | |

Plating solution: Example 6
pH: 7.2
Liquid temperature: 50° C.
Current density: 0.4 A/dm$^2$
Liquid stability: ◎ no trouble was generated by 3-month neglect after the plating test As shown by the results in Table 2, in the instance as Comparative Example 1 that contained neither thioglycolic acid nor cysteine being thiocarboxylic acid-based compounds, eutectoid of Sn and precipitation efficiency gave low values and good precipitation was not obtained. Further, in Comparative Example 1, slight turbidity was generated when the plating solution was prepared, and turbidity was generated after the plating test to show an insufficient result of liquid stability. Furthermore, when concentrations of Au and Sn were increased as in Comparative Example 2, turbidity was generated when pH was adjusted, and a plating solution could not be materialized.

In contrast, as in Examples 1 and 2, in instances that thioglycolic acid and cysteine being thiocarboxylic acid-based compounds were contained, it became possible to perform plating under the eutectic crystal condition of Au:Sn=80:20 at neutral, and stability of the liquid was also good. Moreover, in instances that (A)/Sn=(B)/Sn=2 in molar ratio as in Examples 3 to 6, the result was that plating solutions were materialized without trouble, and arbitrary Au—Sn alloy precipitation ratios were obtained by change of metal concentration or the like. Further, the use of (C) in an appropriate amount made it possible to bring about a more stable state as a plating solution as in Examples 5 and 6.

Under the condition in Example 6 that gave the best result, as shown by the result in Table 3, it was confirmed that a plating treatment with replenishment of a component was also possible, and that a plating solution having good liquid stability and high industrial practicality could be obtained.

Finally, there will be described the result of examining the change in precipitation potential owing to a thiocarboxylic acid-based compound. FIG. 1 shows results of performing measurement of current-potential. The measurement of current-potential was performed under conditions described below on the basis of the composition concentration in Example 3.

pH: 7.0
Liquid temperature: 40° C.
W.E.: 2 cm×2 cm test piece (Cu/burnished Ni plating/Au strike)
R.E.: Ag/AgCl electrode
C.E.: Pt/Ti mesh anode
Sweep rate: 2 mV/s
Measurement liquid:
1: Sn+(B):D(−)-sorbitol
2: Sn+(A):thioglycolic acid+(B):D(−)-sorbitol
3: Au+(B):D(−)-sorbitol As shown in FIG. 1, originally, since Sn(IV) and Au(I) have very large difference in precipitation potentials (1, 2 in FIG. 1), it is difficult to obtain eutectoid, and, even if the eutectoid is obtained, the precipitation ratio changes largely by slight change in the condition. However, by use of thioglycolic acid being a thiocarboxylic acid-based compound (3 in FIG. 1), most of difference in precipitation potentials between Sn and Au disappears and it becomes possible to obtain good alloy precipitation.

INDUSTRIAL APPLICABILITY

According to the present invention, a Au—Sn alloy plating treatment becomes possible without application of a large load to environment and lowering of liquid stability such as deposition generation caused by oxidation of a Sn compound does not occur, and, therefore, a Au—Sn alloy plating treatment of a semiconductor wafer or the like can be performed effectively.

What is claimed is:

1. A non-cyanide based Au—Sn alloy plating solution, comprising a non-cyanide soluble gold salt, a Sn compound composed of tetravalent Sn, a thiocarboxylic acid-based compound, and sugar alcohols.

2. The non-cyanide based Au—Sn alloy plating solution according to claim 1, wherein the thiocarboxylic acid-based compound comprises thiomonocarboxylic acid.

3. The non-cyanide based Au—Sn alloy plating solution according to claim 2, wherein the sugar alcohols comprise D-(−)sorbitol or xylitol.

4. The non-cyanide based Au—Sn alloy plating solution according to claim 3, further comprising a dithioalkyl compound.

5. The non-cyanide based Au—Sn alloy plating solution according to claim 4, wherein the dithioalkyl compound comprises 3,3'-dithiobis(1-propanesulfonic acid) or a salt thereof.

6. The non-cyanide based Au—Sn alloy plating solution according to claim 2, further comprising a dithioalkyl compound.

7. The non-cyanide based Au—Sn alloy plating solution according to claim 6, wherein the dithioalkyl compound comprises 3,3'-dithiobis(1-propanesulfonic acid) or a salt thereof.

8. The non-cyanide based Au—Sn alloy plating solution according to claim 1, wherein the sugar alcohols comprise D-(−)sorbitol or xylitol.

9. The non-cyanide based Au—Sn alloy plating solution according to claim 8, further comprising a dithioalkyl compound.

10. The non-cyanide based Au—Sn alloy plating solution according to claim 9, wherein the dithioalkyl compound comprises 3,3'-dithiobis(1-propanesulfonic acid) or a salt thereof.

11. The non-cyanide based Au—Sn alloy plating solution according to claim 1, further comprising a dithioalkyl compound.

12. The non-cyanide based Au—Sn alloy plating solution according to claim 11, wherein the dithioalkyl compound comprises 3,3'-dithiobis(1-propanesulfonic acid) or a salt thereof.

* * * * *